US006929137B1

(12) United States Patent
Granger et al.

(10) Patent No.: US 6,929,137 B1
(45) Date of Patent: Aug. 16, 2005

(54) COMPOSITE SEALING CAP

(75) Inventors: Jacques Granger, Saint Terre (FR); Yves Peyrin, Saint Remy (FR); Jean-Marie Bourreau, Le Pizou (FR)

(73) Assignee: Pechiney Emballage Alimentaire, Clichy (FR)

( * ) Notice: Subject to any disclaimer, the term of this patent is extended or adjusted under 35 U.S.C. 154(b) by 0 days.

(21) Appl. No.: 09/926,290

(22) PCT Filed: Apr. 17, 2000

(86) PCT No.: PCT/FR00/00992

§ 371 (c)(1),
(2), (4) Date: Oct. 30, 2001

(87) PCT Pub. No.: WO00/63089

PCT Pub. Date: Oct. 26, 2000

(30) Foreign Application Priority Data

Apr. 20, 1999 (FR) ..... 99 05142
Aug. 9, 1999 (FR) ..... 99 10414

(51) Int. Cl.[7] ..... B65D 41/34; B65D 41/62
(52) U.S. Cl. ..... 215/252; 215/219; 215/230; 215/258; 215/901
(58) Field of Search ..... 215/252, 230, 215/219, 258, 901

(56) References Cited

U.S. PATENT DOCUMENTS 3,944,102 A * 3/1976 Grau ..... 215/251
4,440,306 A * 4/1984 Van Buskirk et al. ..... 215/230
4,462,502 A 7/1984 Luenser et al.
4,598,833 A * 7/1986 Herr ..... 215/220
4,629,083 A 12/1986 Druitt
5,197,616 A * 3/1993 Buono ..... 215/220
5,650,113 A 7/1997 Gregory et al.
5,662,233 A 9/1997 Reid
5,667,089 A 9/1997 Moore
5,695,083 A 12/1997 Obadia
5,720,392 A * 2/1998 Price ..... 206/534
5,749,484 A * 5/1998 Trout ..... 215/219
6,276,544 B1 * 8/2001 Battegazzore ..... 215/252
6,403,173 B1 * 6/2002 Granger et al. ..... 428/34.1
6,450,352 B1 * 9/2002 DeJonge ..... 215/217
6,604,643 B1 * 8/2003 Michael et al. ..... 215/204
6,776,311 B2 * 8/2004 Ackermann ..... 222/321.7

FOREIGN PATENT DOCUMENTS

FR 2558445 7/1985
FR 2752560 2/1998
FR 2763046 11/1998

* cited by examiner

*Primary Examiner*—Lee Young
*Assistant Examiner*—Niki M. Eloshway
(74) *Attorney, Agent, or Firm*—Dennison, Schultz, Dougherty & MacDonald

(57) ABSTRACT

The cap (1) comprises a head and skirt and is characterised in that it comprises two assembled parts:

a) an inner part (3) comprising a so-called inner head (30) and a so-called inner skirt (31), typically with a rotation axis (12), carrying out the so-called technical functions of said cap, b) an outer part (4) carrying out all or part of the decorative function of said cap (1), so as to be able to modify the appearance of said cap (1) at will without having to modify said technical functions.

20 Claims, 7 Drawing Sheets

COMPOSITE SEALING CAP

FIELD OF THE INVENTION

The invention relates to the field of caps and, more especially, screw closure caps intended for the closure of recipients or bottles in which the glass ring comprises threading.

These bottles are typically bottles containing aperitifs, liqueurs, alcohol or alcoholic beverages, the consumption of which is typically spread out over time, thus requiring the possibility to close and open said bottles, possibly a large number of times.

These caps most frequently comprise a pilfer-proof or guarantee seal.

DESCRIPTION OF RELATED ART

A large number of sealing caps with guarantee seals are already known.

Some of these caps are made of plastic, as described in the European patent No. 0107 680 in the applicant's name, and typically intended for the closure of plastic water bottles.

Others are made of metal, as described in the French patent No. 2 677 333 or in the French patent applications No. 9705182 or 9706009 in the applicant's name, and typically intended for the closure of bottles containing alcohol, aperitifs and spirits.

Sealing caps form an important part of the packaging of liquids and make a significant contribution to the final appearance and the image of the packaged product.

The invention aims to meet an increasing demand for products enabling a differentiation, a new aesthetic feature in a field involving many constraints and, given these constraints, where the possibilities for modifications are very limited.

These constraints, other than those resulting from obvious functions for use, are firstly constraints related to the industrial manufacturing of caps at high capacities, at a cost that is not prohibitive.

Then, constraints at the packaging company processing the product to be packaged are involved. For the latter, any modification in the cap must not affect the packaging processes, equipment and standard production capacities, unless in the case of an overall reduction in production costs.

In addition to these constraints, those related to the end user, whose habits or possibilities in terms of opening recipients or bottles must always be taken into account in sealing cap design.

SUMMARY OF THE INVENTION

The sealing cap according to the invention, intended for the screw closure of a recipient intended to contain alcoholic beverages, typically a bottle with a neck comprising threading and a pilfer-proof ring, is equipped with sealing means and pilfer-proof means, comprising two assembled parts attached in rotational and axial terms:

a) an inner part, or insert, made of plastic, comprising a so-called inner head and a so-called inner skirt, typically with a rotation axis, with said inner head comprising sealing means and said inner skirt comprising inner threading on its inner surface intended to co-operate with the threading of said neck, b) an outer part, or cap, enclosing and hiding at least said inner skirt, with the outer surface of said inner part and the inner surface of said outer part co-operating in view of said assembly of said inner 3 and outer parts, and is characterised in that, 1) said inner part carries out all the so-called technical functions of said cap, and comprises pilfer-proof means, with said inner skirt connected by bridges to a guarantee seal, intended to be held by the ring of said neck and separated from said skirt after a first opening of said cap, 2) said outer part carries out all or part of the decorative function of said cap, and comprises a so-called outer skirt, the length of which is such that it hides, at least before said first opening of said cap, said inner skirt and said guarantee seal, so as to be able to modify the appearance of said cap at will without having to modify said technical functions, with said guarantee seal becoming typically visible after said first opening.

These means according to the invention make it possible to solve the problem described, as illustrated with the figures described below.

BRIEF DESCRIPTION OF THE DRAWINGS

All the figures, except FIGS. 9*a* and 9*b* relate to cap embodiments according to the invention which comprise an inner part 3 and an outer part 4, with the references starting with a "3" typically relating to said inner part 3, and those starting with a "4" typically relating to said outer part 4.

FIGS. 1*a* to 6*b* are partial vertical half-sections along the axis 12 of the cap 1 screwed onto a neck 2 of a bottle.

For convenience purposes, two embodiments have been represented opposite each other in FIGS. 1*a* and 1*b*, 2*a* and 2*b*, 3*a* and 3*b*, 5*a* and 5*b*, 6*a* and 6*b*. In these figures, the cap is sealed by an added seal 35, except in FIG. 3*b* where sealing is performed by a lip seal 36.

Figure 7:
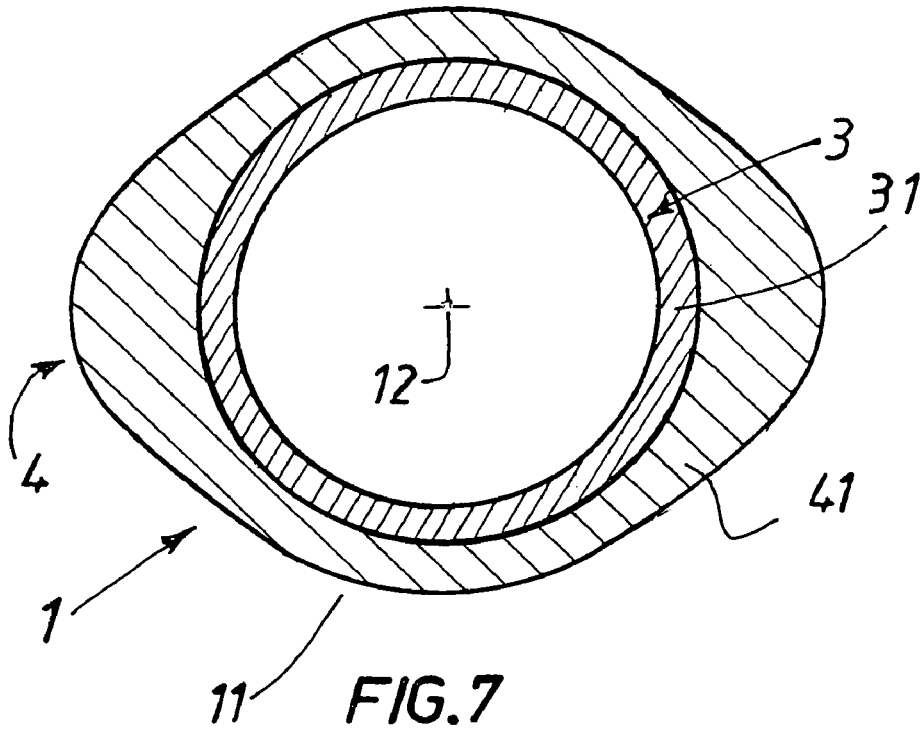
Figure 8:
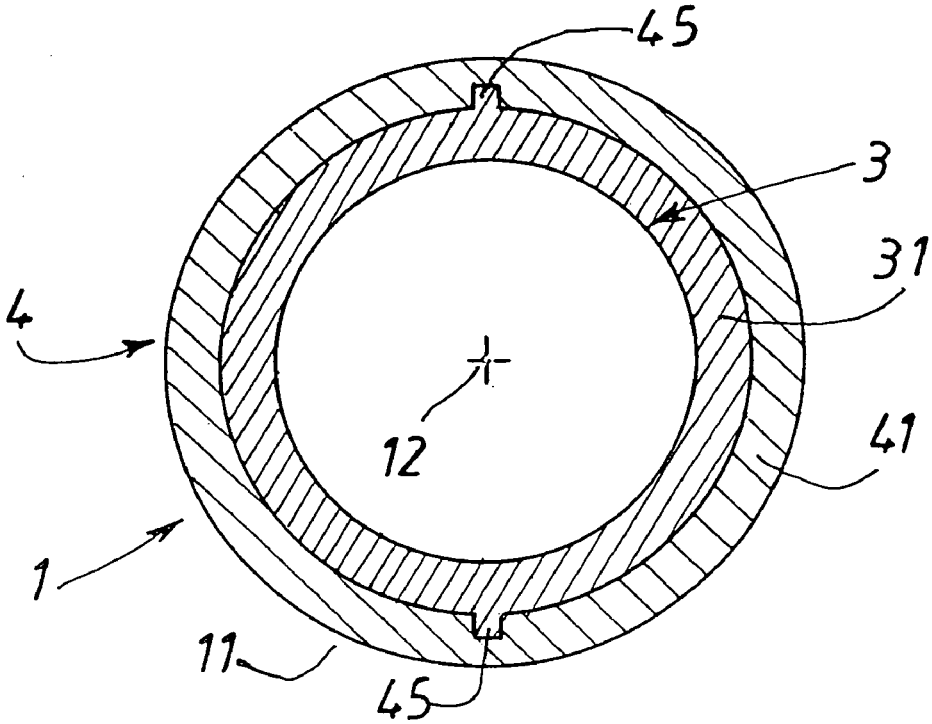

FIGS. 7 and 8 are transversal sections perpendicular to the axis 12 of the cap 1.

Figures 1A, 1B:
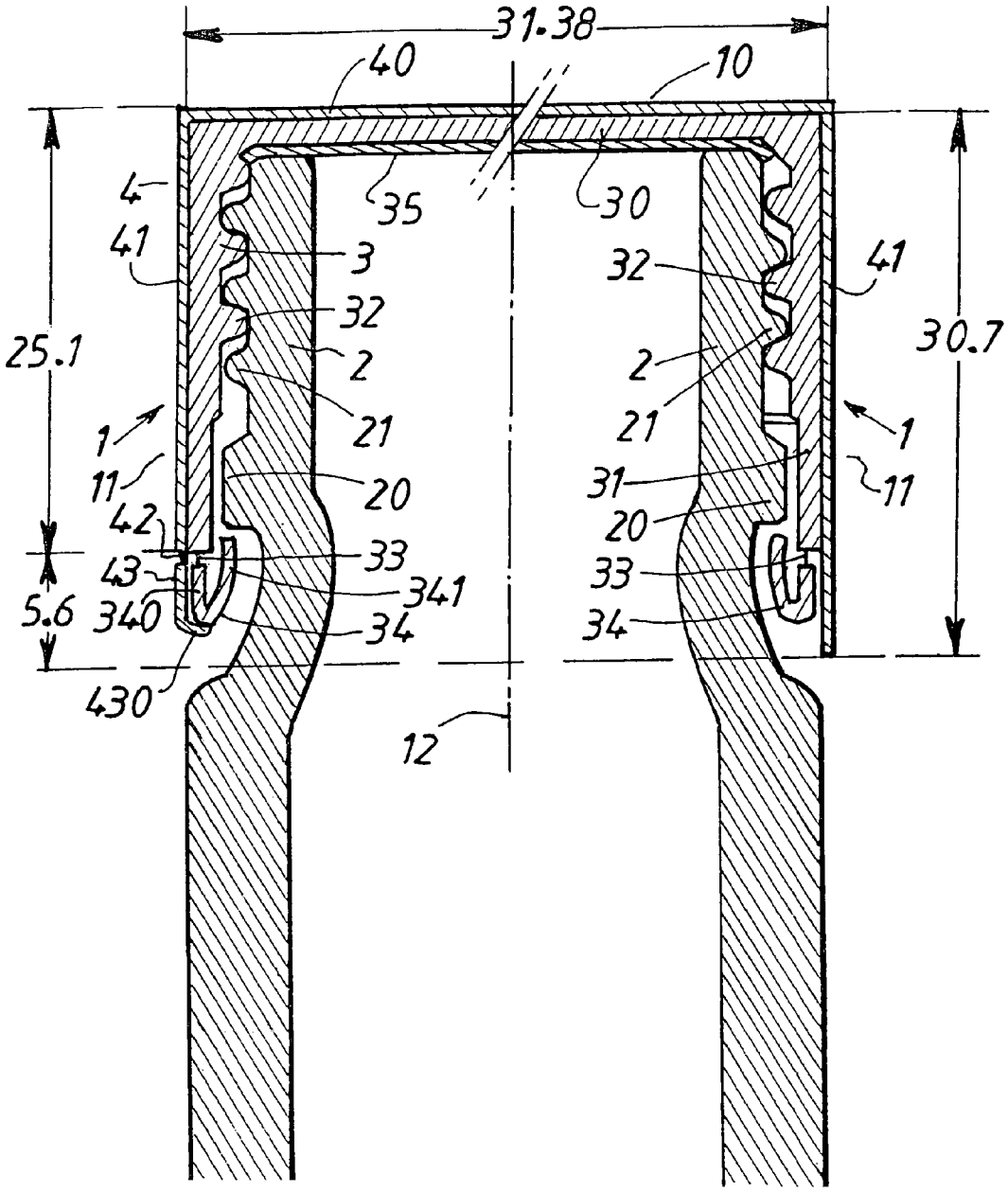
Figures 2A, 2B:
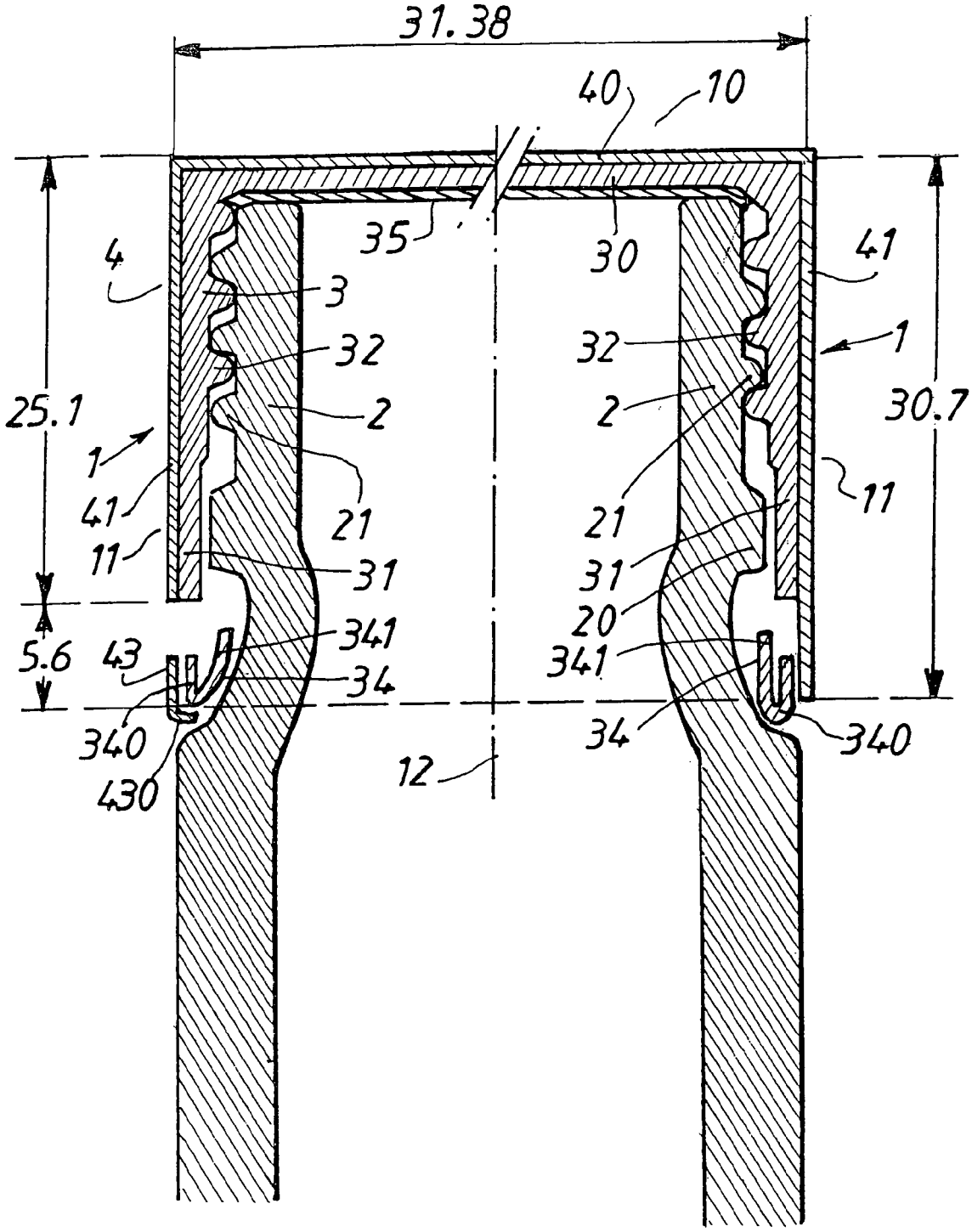
Figures 3A, 3B:
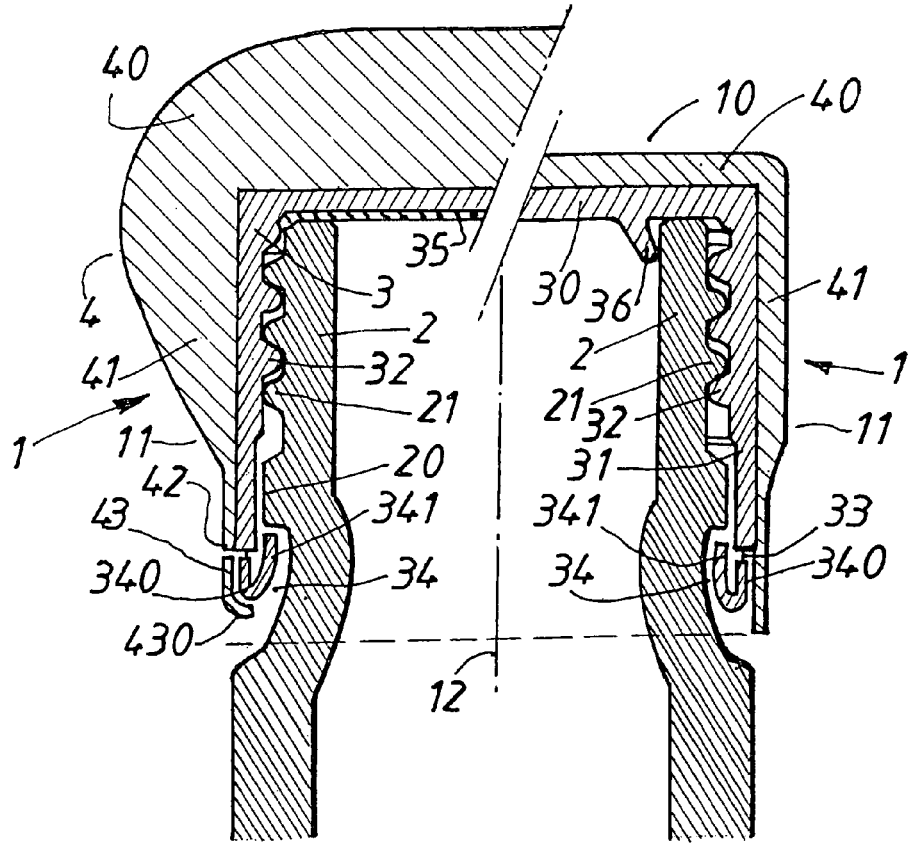
Figures 4A, 4B, 4C, 4D, 4E:
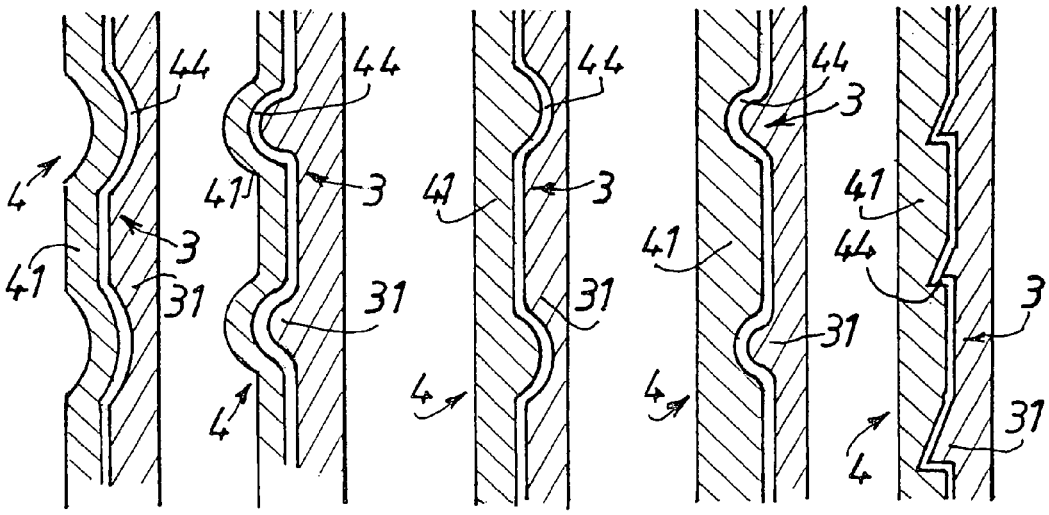
Figures 5A, 5B:
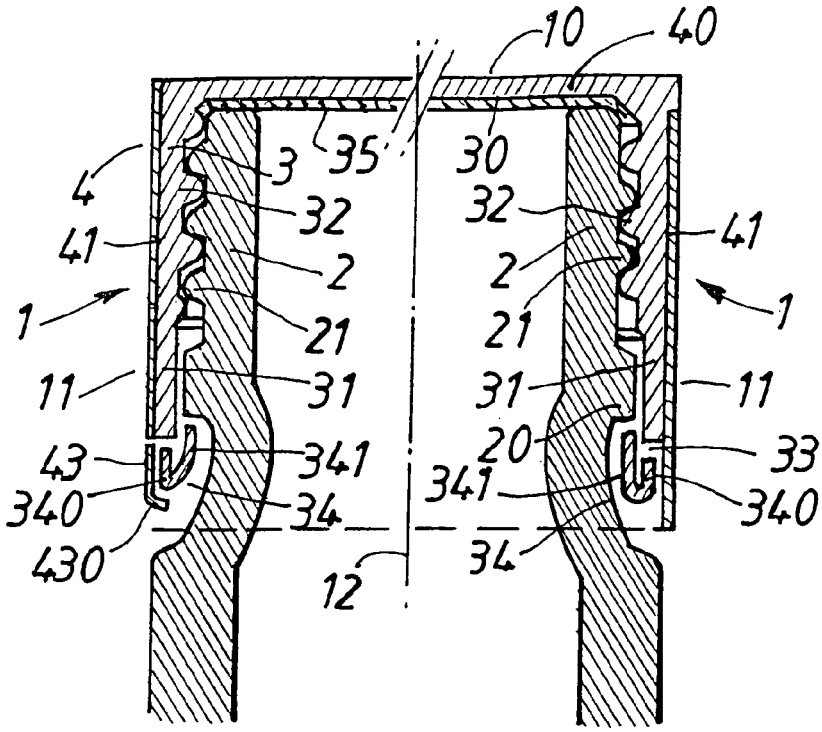
Figures 6A, 6B:
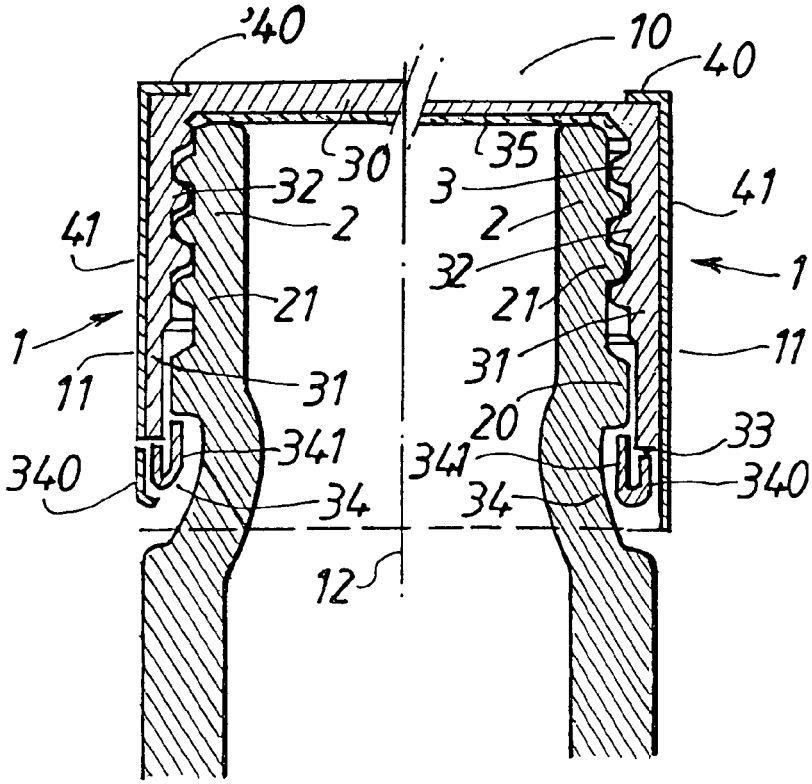

FIGS. 1*a* and 2*a*, as for FIGS. 3*a*, 5*a* and 6*a*, correspond to a first guarantee seal embodiment, before a first opening in FIG. 1*a* and after a first opening in FIG. 2*a*, wherein the ends of both the inner skirt 31 and the outer skirt 41 comprise a series of bridges 33, 42 and a guarantee seal 34, 43.

The inner guarantee seal 34 comprises an inner ring 340 and flexible clips 341 that tend to deflect towards the neck.

The outer guarantee seal 43 comprises a rim 430 which passes under the lower end of the inner guarantee seal 34, such that, upon opening, the two guarantee seals 34 and 43 fall onto the neck and clearly indicate that a first opening has already taken place.

FIGS. 1*b* and 2*b*, as for FIGS. 3*b*, 5*b* and 6*b*, correspond to a second guarantee seal embodiment, before a first opening in FIG. 1*b* and after a first opening in FIG. 2*b*, wherein only the inner skirt 31 comprises a series of bridges 33 and a guarantee seal 34. In this case, the outer skirt 41 is sufficiently long to hide the guarantee seal 34 before the first opening, but sufficiently short so that, once the bridges 33 have been broken, the guarantee seal becomes visible (in FIG. 2*b*) and clearly indicates that a first opening has already taken place.

In FIGS. 1*b* to 2*b*, said outer part 4 covers said inner part 3 entirely and is typically cylindrical in shape, the head 40 being flat, and the skirt 41 being cylindrical.

FIGS. 3*a*, 3*b*, 5*a*, 5*b*, 6*a*, 6*b* and 7 particularly relate to variants of said outer part 4.

FIG. 3*a*: the outer part 4 forms a mushroom cap.

FIG. 3*b*: said outer skirt 41 comprises a two-segment profile of bridgeed straight lines.

This outer part may be made of either moulded plastic or pressed metal and then assembled with said inner skirt 31.

FIGS. 5*a* and 5*b*: said outer part 4 is limited to an outer skirt 41, which covers said inner skirt 31 completely in FIG. 5*a*, and to a significant extent in FIG. 5*b*, the diameter of said inner part 3 being greater where said outer skirt 41 is absent so that said cap has a cylindrical skirt 11 of the same radius over its entire height.

FIGS. 6*a* and 6*b*: said inner head 30 is partially covered by said outer head 40.

In FIG. 6*a*, the thickness of the inner head 30 is increased where the outer head 40 is absent to obtain a uniform, plane head 10, unlike the case in FIG. 6*b*.

FIG. 7: said outer skirt 41 has any non-cylindrical shape.

FIGS. 4*a* to 4*e* represent portions of inner 31 and outer 41 skirts and illustrate assembly embodiments of said inner 31 and outer 41 parts using circular attachment means 44 formed by the co-operation of male circular components on one part, with female components on the other opposite part, so as to eliminate the possibility of a relative movement, in the axial direction, between said inner part 3 and said outer part 4.

FIG. 8 illustrates an assembly embodiment of said inner 31 and outer 41 parts using vertical or axial attachment means 45 formed by the co-operation of axial ribbing on the outer surface of said inner skirt 31 with axial grooves on the inner surface of said outer skirt 41, so as to bridge said inner 3 and outer 4 parts in rotation using mechanical means.

Figure 9A:
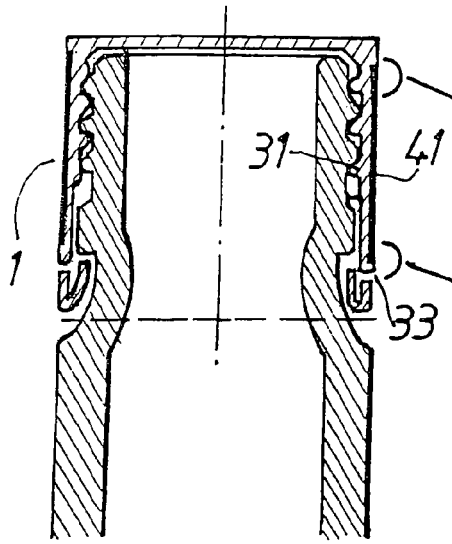
Figure 9B:
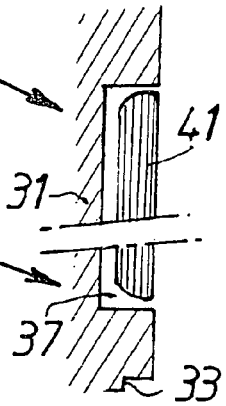
Figure 11A:
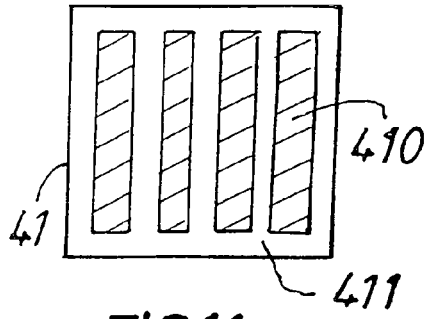
Figure 11B:
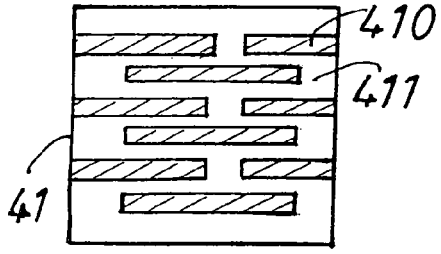

FIGS. 9*a* and 9*b* illustrate an assembly embodiment in which the inner skirt 31 comprises a cylindrical taper 37 on its outer surface in which a skirt 41 may be pressed.

Figure 10A:
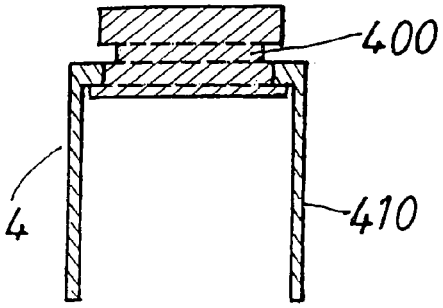
Figure 11C:
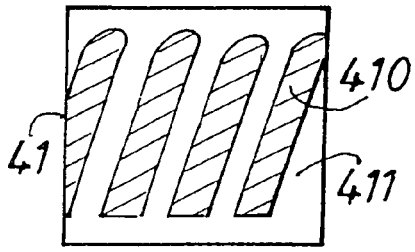
Figure 10B:
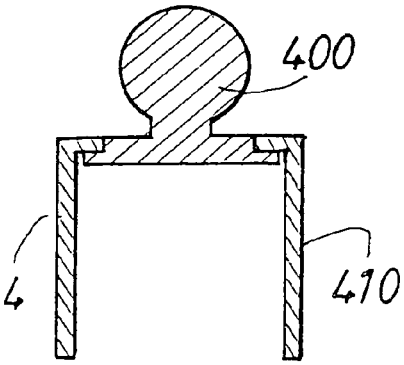
Figure 11D:
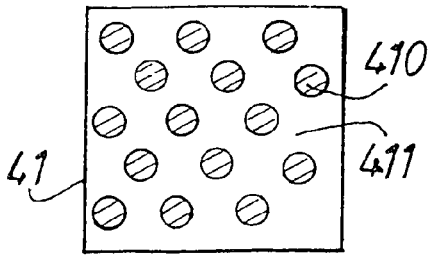

FIGS. 10*a* and 10*b* illustrate another embodiment according to the invention in which said outer part 4 is itself composite and composed of an assembly of a head 400 and a skirt 410, with the possibility of using the same or different constituent materials for said head 400 and said skirt 410, increasing creation possibilities further.

FIGS. 11*a* to 11*d* illustrate the decorative possibilities with the localised surface treatment of an aluminium skirt, so as to obtain a contrast in colour, shine, roughness, in a word, appearance, between the hatched part 410 and the non-hatched background 411.

Figure 12B:
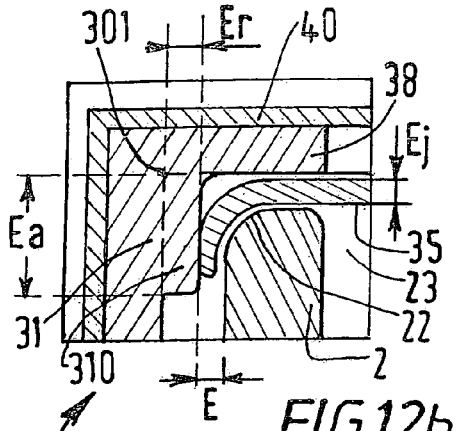
Figure 12C:
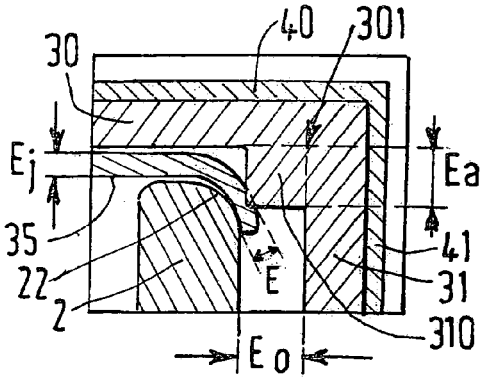
Figure 12A:
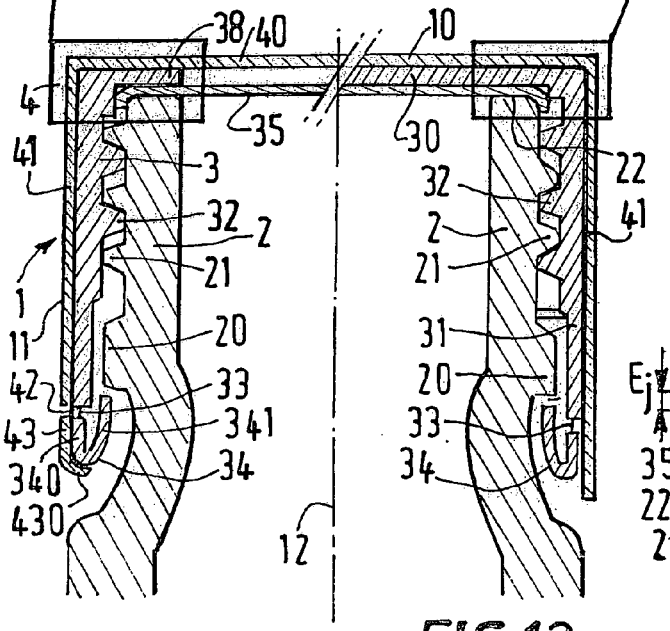

FIGS. 12*a* to 12*f* are partial axial section (FIG. 12*a*) or enlarged 12*b* to 12*f* views illustrating radial and/or compression means embodiments intended to increase tightness;

FIG. 12*a* illustrates two embodiments of radial compression means.

In the embodiment represented in the left section of FIG. 12*a*, which is enlarged in FIG. 12*b*, the compression means forms a step with Ea>Er and the inner head is shaped like an annular rim which approximately covers the edge 22 of the neck.

However, in the embodiment represented in the right section of FIG. 12*a*, which is enlarged in FIG. 12*c*, the compression means forms a step with Ea similar to Er and the inner head 30 is solid.

Figure 12F:
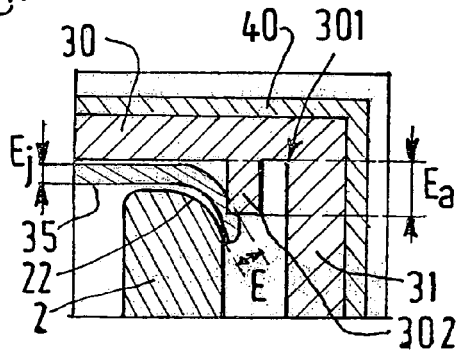
Figure 12D:
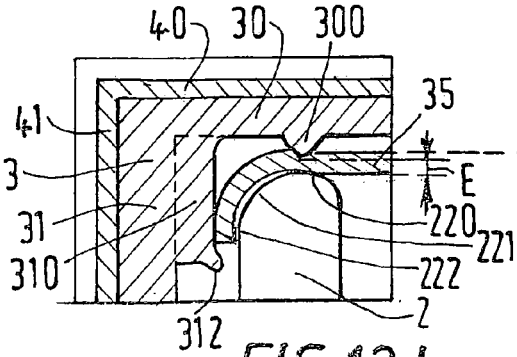

FIG. 12*d* illustrates an example of axial compression using a circular rib 300. A circular rib or holding rim 312 enables the seal to remain attached to the cap before use.

Figure 12E:
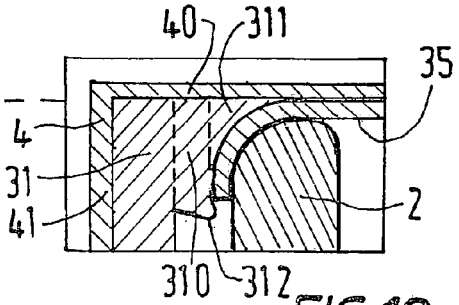

FIG. 12*e* illustrates an example of an insert applying radial compression with a curved part 311, with the insert not comprising an inner head.

FIG. 12*f* illustrates an example of an insert applying radial compression with compression means attached to said inner head 30 and not said skirt 31.

DETAILED DESCRIPTION OF THE INVENTION

According to the invention, said outer part 4 may comprise a so-called outer skirt 41, and, if applicable, head 40.

Most of the figures illustrate this embodiment.

However, special decorative effects could be obtained if the skirt of the cap 1 was partly composed of a portion of said inner skirt 31 and partly of a portion of said outer skirt 41, as would be the case in FIG. 5*b* with a shorter outer skirt 41.

Typically, said outer part 4 may comprise a straight, typically cylindrical, skirt 41, which corresponds to the most common case, but the invention can also be used to create originally shaped caps, with a non-cylindrical straight skirt 11 as represented as a section in FIG. 7, or a non-straight skirt, as represented in FIG. 3*a*.

Said outer part 4 may form a rotation surface, of a constant radius or not depending on the height in question, as illustrated in FIG. 3*a*.

In any case, said outer part 4, of any outer shape, is attached to said inner part 3; for this, said outer part 4 and said inner part 3 use mechanical 44, 45 or chemical attachment means, typically by gluing, as the means for said assembly.

Mechanical attachment means have been represented in FIGS. 4*a* to 4*e* and 8. The inner 3 and outer 4 parts may also be assembled using a snap-on or clip-on mechanism, with the materials and/or thickness of the parts 3 and 4 enabling elasticity and spring effects enabling their assembly.

In the other figures, the attachment means has not been represented, since it consists of gluing, using a layer of adhesive, or heat-sealing, of all or part of said inner part 3 on all or part of said outer part 4.

According to the invention, said inner part 3 may be a PP insert, comprising inner threading 32, on which the guarantee seal 34 comprises clips 341.

Such an insert may be obtained by PP moulding or injection. It is possible to obtain such a plastic insert as described in the European patent No. 107 680 in the applicant's name.

According to an embodiment of the invention, said outer part 4 may be of metal, or comprise a metal part inside, and be attached to said insert 3 by gluing.

In this case, said outer part 4 may be made of surface-treated aluminium, typically brushed or anodised, to create a "metallic" colour or appearance.

According to another embodiment of the invention, said outer part 4 may be made of plastic, typically polystyrene, and attached to said insert by mechanical assembly or by gluing. Preferably, said plastic outer part 4 is metal-coated.

Whether by using surface-treated aluminium or coating plastic with metal, the invention makes it possible to obtain a wide variety of decorative effects.

The caps according to the invention may comprise any type of guarantee seal known in itself. Typically, said guarantee seal 34 comprises an inner ring 340 equipped with fastening components 341, typically clips or hooks, turned towards the inside of said cap, and snapped under said ring 20 such that, during said first opening, the bridges 33 break, with said guarantee seal 34 prevented from moving upwards by the co-operation of said components 341 with said ring 20, such that said guarantee seal 34, separated from the rest of said cap, is the visible proof of said first opening.

An example of a guarantee seal, among the many known, is given in the European patent No. 107 680.

In the cases of caps illustrated in FIGS. 1*b*, 3*b*, 5*b* and 6*b*, the outer skirt 41 hides said guarantee seal 34, before said first opening. However, at the first opening, during which the bridges 33 are broken, the guarantee seal, separated from the rest of the skirt, falls and is lowered by a few millimeters on the neck and becomes visible as a result, even on a closed bottle, as illustrated in FIG. 2*b*.

According to another embodiment illustrated particularly in FIGS. 1*a* and 1*b*, said outer skirt 41, like the inner skirt 31, comprises bridges 42 attaching it to a so-called outer ring 43, with said outer ring locked upwards by said inner ring 340, typically by means of a lower rim 430 of said outer ring 43, such that, during said first opening, the outer 43 and inner 340 rings are separated from the rest of said cap.

In any case, the ring 20, by locking, during the first unscrewing, the clips 341 or any component of a guarantee seal of said inner part 3, fulfilling an equivalent function, breaks the bridges 33, and, if applicable, the bridges 42, and therefore causes the guarantee seal to fall onto the neck of the bottle, making it possible to see, unequivocally, that a first opening has already taken place.

The caps according to the invention may comprise any sealing means known in itself, typically by using either a circular lip 36 attached to said inner head, as illustrated in FIG. 3*b*, or an added seal 35 as illustrated in the other figures concerning the cap 1.

More precisely, the caps may comprise, in order to guarantee the tightness of the recipient once closed, an added seal 35 of sufficient diameter to cover the edge 22 of the neck 2 and axial and/or radial compression means on the inner surface of said insert, to apply said seal in a tight manner onto said edge 22 of said neck 2 during said closure.

A compression means is said to be axial when it is applied onto the upper part 220 of the edge, and it is said to be radial in the other cases, when it is applied either onto the curved part 221 or onto the vertical part 222 of the edge, as illustrated in FIG. 12*d*.

Said axial compression means may comprise a circular rib 300 formed on the inner wall of said inner head 30 intended to compress said seal onto the upper part 220 or said edge 22, typically plane, as illustrated in FIG. 12*d*.

Said radial compression means may comprise an annular extra thickness 310, 302 formed on said inner skirt 31 or on said inner head 30, typically at the bridge 301 between the inner head 30 and the inner skirt 31, and intended to compress said seal onto all or part of the curved part 221, typically inclined, and/or onto the radial part 222, typically vertical, of the edge 22. This extra thickness may be attached to the inner skirt 31, as illustrated in FIGS. 12*a* to 12*e* with the reference "310", or attached to the inner head 30 as illustrated in FIG. 12*f* with the reference "302".

According to a variant illustrated in FIGS. 12*a* to 12*d*, said annular extra thickness 310 may take the form of an annular step positioned at the inner annular angle formed at the bridge of the inner head 30 and the inner skirt 31.

According to another variant illustrated in FIG. 12*b*, said inner head 30 may comprise an annular rim 38 with a punched central part, typically opposite the mouth 23 of said neck 2. This variant makes it possible to save weight and material for the plastic insert 3, particularly in the case of radial compression means.

Indeed, the applicant has observed that, the greater the radial type of compression effort, the greater the possibility to reduce the thickness of said inner head 30.

In this case, as illustrated in FIG. 12*e*, the cap will have the following characteristics:

a) said inner head 30 has a thickness ranging from 0 to 0.5 mm, b) said compression means is typically radial, and c) this compression means comprises a curved part 311 with a curvature typically similar to that of the curved part 221 of said edge which is opposite.

This embodiment makes it possible to reduce the height of the cap, typically by 1 to 2 mm, which may be very useful in practice, given the standardisation constraints in the field of packaging.

The specialist may adapt the shape and exact dimensions of the insert and the axial and/or radial compression means, e.g. the thickness Ea and Er as illustrated in FIG. 12*b*. Indeed, he may choose the thickness of said compression means as a function of the thickness Ej of the seal and the space Eo between said neck and said cap in particular, such that said recipient is closed in a tight manner by said cap, the thickness of the locally compressed seal or the distance E between the end of said compression means and said edge being typically between 0.2 Ej and 0.7 Ej, where Ej is typically between 1 and 2.5 mm.

Said axial and/or radial compression may be an integral part of said insert 3 or form an added part.

Preferably, said compression means is an integral part of said insert, as illustrated in FIGS. 12*a* to 12*f*.

It is advantageous for the cap according to the invention to comprise holding means for said added seal, typically a holding rim 312 attached to said inner skirt 31.

Examples of Applications

Firstly, we manufactured inner parts or inserts 3 in PP with a cylindrical outer surface, with a guarantee seal 34, according to the process described in the European patent No. 107 680, and according to a common model for the figures attached, such as FIGS. 1*a* to 2*b*.

Secondly, we manufactured different outer parts or caps 4:

in aluminium as represented in FIGS. 1*a* to 2*b*, with different surface treatments, as illustrated in FIGS. 11*a* to 11*d*, in metal-coated polystyrene, as represented in FIGS. 1*a* to 2*b*.

Finally, we assembled the caps 4 and the inserts 3 using an adhesive.

We also manufactured caps according to FIGS. 12*b* and 12*e* using a commercially available seal 35.

Advantages of the Invention

The invention makes it possible to solve the problem described and paves the way for a wide diversity in terms of appearance. However, these caps offer the same usage behaviour in response to the constraints encountered.

Therefore, the invention enables individualisation and customisation of caps acceptable in economic terms, using the concept according to the invention separating technical functions and aesthetic functions.

LIST OF REFERENCES

SEALING CAP . . . 1
HEAD . . . 10
SKIRT . . . 11
ROTATION AXIS . . . 12
NECK OF RECIPIENT . . . 2
PILFER-PROOF RING . . . 20
THREADING . . . 21
EDGE . . . 22

UPPER PART . . . 220
CURVED PART . . . 221
VERTICAL PART . . . 222
MOUTH . . . 23
INNER PART OR INSERT . . . 3
INNER HEAD . . . 30
CIRCULAR RIB . . . 300
HEAD-SKIRT BRIDGE . . . 301
ANNULAR EXTRA THICKNESS . . . 302
INNER SKIRT . . . 31
ANNULAR EXTRA THICKNESS . . . 310
CURVED PART . . . 311
HOLDING RIM . . . 312
INNER THREADING . . . 32
BRIDGES . . . 33
GUARANTEE SEAL . . . 34
INNER RING . . . 340
CLIPS . . . 341
ADDED SEAL . . . 35
LIP SEALS . . . 36
TAPER . . . 37
HEAD/ANNULAR RIM . . . 38
OUTER PART OR CAP . . . 4
OUTER HEAD . . . 40
COMPOSITE HEAD . . . 400
OUTER SKIRT . . . 41
COMPOSITE SKIRT . . . 410
BRIDGES . . . 42
OUTER RING . . . 43
LOWER RIM . . . 430
CIRCULAR ATTACHMENT MEANS . . . 44
VERTICAL ATTACHMENT MEANS . . . 45

What is claimed is:

1. Sealing cap for screw closure of a receptacle for alcoholic beverages in the form of a bottle with a neck, equipped with sealing means and pilfer-proof means, comprising two assembled parts attached, in rotational and axial terms:

a) an inner part or insert, made of plastic, comprising an inner head and an inner skirt, with said inner head comprising sealing means and said inner skirt comprising inner threading on its inner surface intended to co-operate with threading of the neck, and b) an outer part or cap made of metal or comprising a metal portion, enclosing and hiding at least said inner skirt, with the outer surface of said inner part and the inner surface of said outer part co-operating in view of the assembly of said inner and outer parts, wherein the inner part comprises pilfer-proof means, with said inner skirt connected by bridges to a guarantee seal held by a ring of the neck axial separated from said skirt after a first opening of said cap, said outer part carries all decorations of said cap, and comprises an outer skirt having a length sufficient to hide, at least before the first opening of said cap, said inner skirt and said guarantee seal, so as to be able to modify the appearance of said cap at will without having to modify any technical functions, with said guarantee seal becoming visible after the first opening, wherein said guarantee seal comprises an inner ring equipped with fastening components turned towards the inside of said cap, and snapped under said ring such that during the first opening, the bridges break, with said guarantee seal prevented from moving upwards by the co-operation of said components with said ring, and such that said guarantee seal separated from the rest of said cap, becomes the visible proof of said first opening, and wherein said outer skirt comprises bridge attaching it to an outer ring, with said outer ring being locked upwards by said inner ring, such that during the first opening, the outer and inner rings are separated from the rest of said cap.

2. Cap according to claim 1, wherein said outer part comprises an outer head.

3. Cap according to claim 1, wherein said outer part comprises a straight skirt.

4. Cap according to claim 1, wherein said outer part forms a rotation surface which is of a constant radius.

5. Cap according to claim 1, wherein said outer part and said inner part comprise mechanical or chemical attachment means, for said assembly to said inner part.

6. Cap according to claim 5, wherein the attachment means comprises gluing.

7. Cap according to claim 1, wherein said inner part is a polypropylene insert, equipped with inner threading on which the guarantee seal comprises clips.

8. Cap according to claim 1, wherein said outer part is made of surface treated aluminum which creates a metallic color or appearance.

9. Cap according to claim 8, wherein the surface treatment is brushing or anodizing.

10. Cap according to claim 1, wherein said outer ring is locked upwards by said inner ring by means of a lower rim of said outer ring.

11. Cap according to claim 1, wherein said sealing means comprises an added seal or a circular lip attached to said inner head.

12. Cap according to claim 11, further comprising an added seal of sufficient diameter to cover the edge of the neck and axial and/or radial compression means on the inner surface of said insert, to apply said seal in a tight manner onto said edge of said neck during closure.

13. Cap according to claim 12, wherein said axial compression means comprises a circular rib formed on the inner wall of said inner head for compressing said seal onto the upper part of said edge.

14. Cap according to claim 12, wherein said radial compression means comprises an annular extra thickness formed on said inner skirt or on said inner head for compressing said seal onto all or part of the curved part and/or onto the radial part of the edge.

15. Cap according to claim 14, wherein said annular extra thickness takes the form of an annular step positioned at the inner annular angle formed at the bridge of the inner head and the inner skirt.

16. Cap according to claim 12, wherein said inner head comprises an annular rim with a punched central part.

17. Cap according to claim 12, wherein:

said inner head hat a thickness of from 0 to 0.5 mm, said compression means comprises a curved part.

18. Cap according to claim 12, wherein the thickness of said compression means is selected as a function of the thickness Ej of the seal and the space Eo between said neck and said cap, such that said receptacle is closed in a tight manner by said cap.

19. Cap according to claim 12, wherein axial and/or radial compression means is an integral part of said insert or forms an added part.

20. Cap according to claim 11, comprising holding means for said added seal.

* * * * *